US011315727B2

(12) United States Patent
Venegas Vega et al.

(10) Patent No.: US 11,315,727 B2
(45) Date of Patent: Apr. 26, 2022

(54) EXPLOSION-PROOF INDUCTIVE VOLTAGE TRANSFORMER

(71) Applicant: Arteche North America S.A. de C.V., Hidalgo (MX)

(72) Inventors: Marco Antonio Venegas Vega, Tula de Allende (MX); Juan Pablo Estrada Carbajal, Naucalpan (MX)

(73) Assignee: ARTECHE NORTH AMERICA S.A. DE C.V., Hidalgo (MX)

( * ) Notice: Subject to any disclaimer, the term of this patent is extended or adjusted under 35 U.S.C. 154(b) by 105 days.

(21) Appl. No.: 15/981,567

(22) Filed: May 16, 2018

(65) Prior Publication Data

US 2019/0355513 A1 Nov. 21, 2019

(51) Int. Cl.
*H01F 27/02* (2006.01)
*H01F 27/40* (2006.01)
*H01F 27/06* (2006.01)

(52) U.S. Cl.
CPC ..... *H01F 27/402* (2013.01); *H01F 27/022* (2013.01); *H01F 27/06* (2013.01)

(58) Field of Classification Search
USPC ..... 336/5, 192, 90
See application file for complete search history.

(56) References Cited

U.S. PATENT DOCUMENTS 3,281,521 A * 10/1966 Wilson ..... H01F 38/30 174/17 GF
4,775,849 A * 10/1988 Lucas ..... H01F 27/02 336/90
7,834,736 B1 * 11/2010 Johnson ..... H01F 27/022 336/182
2010/0296208 A1 * 11/2010 Tekletsadik ..... H01F 6/00 361/43
2012/0126923 A1 5/2012 Navarro et al.
2012/0286915 A1 11/2012 Mattozzi et al.
2014/0232509 A1 8/2014 Shaw et al.
2014/0262492 A1 * 9/2014 Tekletsadik ..... H01L 39/16 174/650

* cited by examiner

*Primary Examiner* — Mang Tin Bik Lian
(74) *Attorney, Agent, or Firm* — Crowell & Moring LLP; John C. Freeman

(57) ABSTRACT

An explosion-proof inductive voltage transformer (IVT) of the type comprising: i) a high voltage section that receives a high voltage current, limits and insulates the high voltage current to be transformed and reduces its electrical stress; and, ii) a voltage transforming section connected to the high voltage section and contained in an insulation body in order to protect the elements of the voltage transforming section and reduce the impact of explosions in case of electrical failure, wherein the voltage transforming section comprises means for reducing the voltage of the high voltage current to a low voltage and electric transmission means that transmit a resulting low voltage current to a low voltage distribution line; wherein the voltage transforming section of the IVT further comprises shock mitigation means comprising at least one hollow section located opposite the high voltage section that, during an electrical failure causing an explosion, direct the gases and shockwave of the explosion towards the hollow section, thereby reducing the damage caused by the explosion to the IV transformer and its surroundings; provides an explosion-proof inductive voltage transformer easy to install and with a low cost manufacture.

18 Claims, 5 Drawing Sheets

EXPLOSION-PROOF INDUCTIVE VOLTAGE TRANSFORMER

FIELD OF THE INVENTION

The present invention is related to electrical devices, and more particularly it is related to an explosion-proof inductive voltage transformer.

BACKGROUND OF THE INVENTION

Inductive Voltage Transformers (IVT), are used for voltage metering and protection in high or medium voltage network systems and they are designed to provide a scaled down replica of the voltage in the high or medium voltage line and isolate the measuring instruments, meters, relays, etc., from the high voltage power circuit. They transform the high or medium voltage into low voltage adequate to be processed in measuring and protection instruments secondary equipment, such as relays and recorders.

Nowadays, inductive voltage transformers (IVT) have some problems related to electrical failures. For instance, they are prone to explosions due to a short circuit, ferroresonance occurrences, a power surge, or an internal electric arc or internal arc discharge.

Currently some IVT deal with those problems by installing special chambers or capsules that protect the surroundings in case of an explosion. However, these special chambers are complicated to manufacture and to install, as well as very expensive. Moreover, these chambers only protect the nearby facilities, but they do not offer protection to the transformer itself, resulting in a partial or complete destruction of the transformer after a failure occurs.

For example, in US2012286915 the transformer is encapsulated to provide protection and insulation. The encapsulation consists of an outer part forming a shell and an inner part that is molded in the shell. The shell and the inner part are made of a thermoplastic material. The shell protects and insulates on the outside but it does not prevent an explosion neither protect the transformer of the mechanical stress caused by the explosion.

On the other hand, document US2012126923 describes a dry distribution transformer that does not need a protective cubicle; instead it is submerged in a liquid in order to reduce the risk of explosions. However, this results in having to create a special infrastructure to be able to submerge the transformer that is costly and difficult to install. On another note, the transformer of document US2014232509 integrates an electrostatic shield for controlling electrostatic field stress, but this only protects the transformer against discharges and leaves it vulnerable to other electrical failures.

Based on the foregoing, there is a need for implementing a mechanism inside the inductive voltage transformers (IVT) in order to mitigate the effects of an explosion caused by an electrical failure (e.g., short circuit, ferroresonance occurrences, a power surge, or an internal electric arc or internal arc discharge) and also to prevent partial or total destruction of the transformer.

OBJECTS OF THE INVENTION

Considering the drawbacks of the prior art, it is an object of the present invention to provide an explosion-proof inductive voltage transformer.

It is another object of the present invention to provide an explosion-proof inductive voltage transformer easy to install and manufacture, which is low cost compared to the devices and mechanisms used in the state of the art.

BRIEF DESCRIPTION OF THE INVENTION

The present invention relates to an inductive voltage transformer (IVT) of the type comprising:

I) a high voltage section that receives a high voltage current, limits and insulates the high voltage to be transformed and reduces its electrical stress; and, ii) a voltage transforming section connected to the high voltage section and contained in an insulation body in order to protect the elements of the voltage transforming section and reduce the impact of explosions in case of electrical failure, wherein the voltage transforming section comprises means for reducing the voltage of the high voltage to a low voltage and electric transmission means that transmit a resulting low voltage to a low voltage distribution line;

wherein the voltage transforming section of the IVT further comprises shock mitigation means comprising at least one hollow section located opposite the high voltage section that, during an electrical failure causing an explosion, direct the gases and shockwave of the explosion towards the hollow section, thereby reducing the damage caused by the explosion to the IV transformer and its surroundings.

The novel aspects of the invention, as well as the operation and advantages thereof will be better understood from the figures and the detailed description of the invention.

BRIEF DESCRIPTION OF THE DRAWINGS

Novel aspects considered characteristic of the present invention will be established particularity in the claims section. However, some embodiments, characteristics and some objects and advantages thereof will be better understood from the detailed description, when read related to the drawings, wherein:

DETAILED DESCRIPTION OF THE INVENTION

Figure 1:
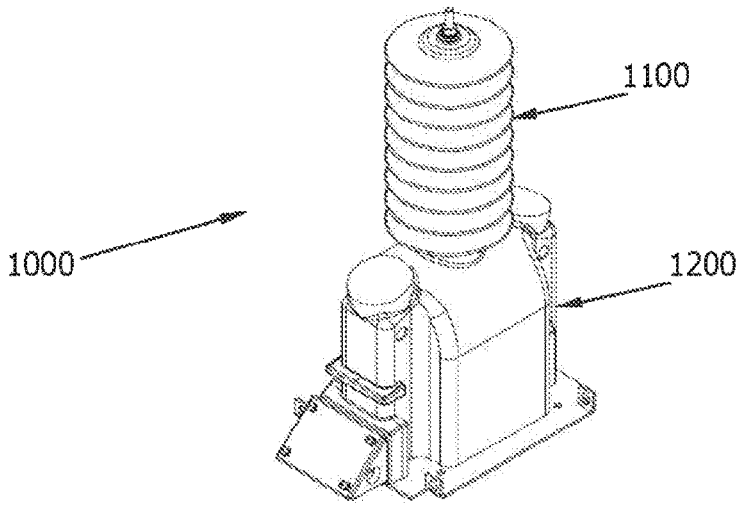
FIG. 1 represents a superior perspective view of an explosion-proof IVT (1000), and a high voltage section (1100), according to an embodiment of the present invention.

During the development of the present invention, it has been found that an explosion-proof inductive voltage (IVT) of the type including:

I) a high voltage section that receives a high voltage, limits and insulates the high voltage to be transformed and reduces its electrical stress; and, ii) a voltage transforming section connected to the high voltage section and contained in an insulation body in order to protect the elements of the voltage transforming section and reduce the impact of explosions in case of electrical failure, wherein the voltage transforming section includes means for reducing the voltage of the high voltage to a low voltage and electric transmission means that transmit a resulting low voltage to a low voltage distribution line;

wherein the voltage transforming section of the IVT further includes shock mitigation means including at least one hollow section located opposite the high voltage section that, during an electrical failure causing an explosion, direct the gases and shockwave of the explosion towards the hollow section, thereby reducing the damage caused by the explosion to the IV transformer and its surroundings; provides an explosion-proof inductive voltage transformer easy to install and with a low cost manufacture.

In a specific embodiment of the present invention, the IVT is a dry-type transformer.

In one particular embodiment of the present invention, the high voltage section is covered by a flexible hydrophobic cycloaliphatic resin.

In other embodiment of the present invention, the high voltage section includes at least one primary electrical element which in turn includes a primary terminal that receives the high voltage, a current limiting element that limits the high voltage and reduces its electrical stress, and an insulated element or bushing that insulates the high voltage. Preferably, the high voltage section includes one or two primary electrical elements. The high voltage section is connected to the voltage transforming section through at least one primary electrical element of the high voltage section and the means for reducing the voltage of the voltage transforming section, wherein each primary electrical element is separately connected to the means for reducing the voltage of the high voltage to a low voltage.

The primary electrical element is preferably covered by cycloaliphatic resin.

Now, the current limiting element of each primary electrical element may also absorb the energy caused by the electrical failure and it may provide insulation, and preferably comprises a porcelain cartridge to provide heat protection which in turn comprises arc extinction sand that immerses a fuse to provide overcurrent protection, said fuse is mounted on a fiberglass core to provide insulation. Furthermore, the fuse preferably is a silver fuse. In the case of the arc extinction sand, this is preferably quartz sand.

Referring to the insulated element or bushing of each primary electrical element, this is preferably selected from porcelain or resin type insulation and even more preferably it is selected from resin type insulation.

In one embodiment of the present invention, the insulation body of the voltage transforming section comprises an outside layer and an inside layer made of polymeric materials to insulate the voltage transforming section, and a base to mount the IVT.

On one hand, the outside layer is preferably made of cycloaliphatic resin and even more preferably the outside layer is made of a flexible hydrophobic cycloaliphatic resin.

On the other hand, the inside layer is preferably made of an epoxy resin and even more preferably the inside layer is made of Bisphenol A (BPA) resin.

Regarding the base of the voltage transforming section, this has preferably the shape of a plate.

As said before, the voltage transforming section includes means for reducing the voltage of the high voltage to a low voltage. Preferably, the voltage transforming section includes means for reducing the voltage for each primary electrical element included in the high voltage section. For purposes of the present invention, the term "means for reducing the voltage" refers to the transformer tank or central part of the same and all the components that are comprised in it. In one embodiment of the present invention, the means for reducing the voltage of the high voltage to a low voltage includes: at least one primary electromagnetic coil or primary winding that receives the current from the primary electrical element and generates a magnetic field through at least one magnetic circuit or core; at least one magnetic circuit or core that induces the low voltage to at least one secondary electromagnetic coil or secondary winding; and at least one secondary electromagnetic coil or secondary winding connected to the electric transmission means that receives the resulting low voltage. For purposes of the present invention, the term "electromagnetic coil" or "winding" refers to several turns of a conducting material bundled together and connected in series; and the term "magnetic circuit" or "core" refers to a support of the primary and secondary electromagnetic coils in the transformer and it is fabricated of one or more closed loop paths enclosing a magnetic flux.

In addition, the primary and secondary electromagnetic coils are preferably composed of a conductive metal and even more preferably they are composed of copper.

Moreover, the magnetic circuit is preferably composed of a ferromagnetic material and even more preferably the magnetic circuit is composed of iron.

For purposes of the present invention, the term "electric transmission means" refers to the output connections of the transformer inner circuit that send the low voltage to an external circuit. In one embodiment, the electric transmission means preferably comprise a secondary terminal that receives the resulting low voltage and it may be connected to a low voltage distribution line; and a secondary terminal box that contains and protects said secondary terminal. For purposes of the present invention, the term "secondary terminal" refers to the point where the transformer inner circuit ends and it provides a connection to an external circuit; and the term "secondary terminal box" refers to a box which contains and protects the secondary terminal and comprises at least one external plug to facilitate the connection between the secondary terminal and the external circuit.

In regard to the shock mitigation means, they preferably comprise two hollow sections that during an electrical failure causing an explosion will direct the gases and shockwave of the explosion towards the opposite side of the high voltage section, thereby reducing the damage caused by the explosion to the IVT and its surroundings.

In this sense, the two hollow sections are located opposite the high voltage section preferably at the bottom-lateral ends of the inside layer of the insulation body.

In an embodiment of the present invention, the electrical failure may be a short circuit, ferroresonance occurrences, a power surge, an internal electric arc or internal arc discharge.

One advantage of the present invention is that the shock mitigation means provide an easy and low cost approach for preventing or reducing the damage to an IVT and its surroundings in case of an explosion caused by an electrical failure.

To better comprehend the principles of the present invention, it will be described with respect to the embodiments illustrated in FIGS. 1 to 6.

FIG. 1 represents a superior perspective view of the explosion-proof IVT (1000), with one primary electrical element (1100), according to an embodiment of the present invention. FIG. 1 shows the explosion-proof inductive voltage transformer or IV transformer (1000) of the type including the high voltage section (1100) that receives a high voltage, limits and insulates the high voltage to be transformed and reduces its electrical stress; and the voltage transforming section (1200) connected to the high voltage section and contained in an insulation body in order to protect the elements of the voltage transforming section and reduce the impact of explosions in case of electrical failure.

Figure 2A:
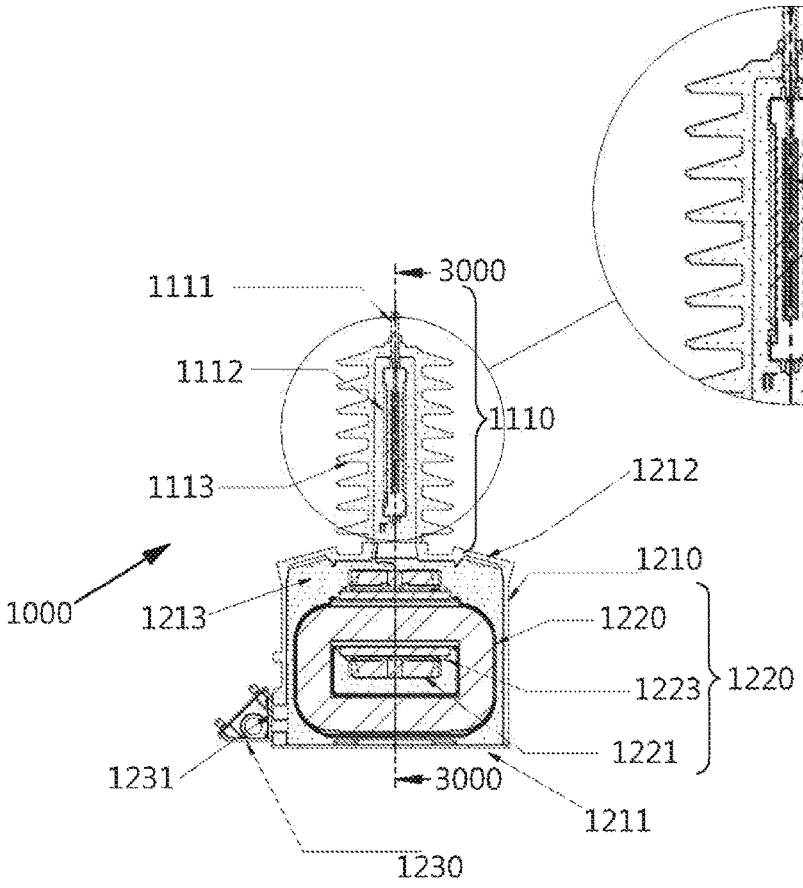
FIG. 2A represents a longitudinal cross section view of the explosion-proof IVT (1000) shown in FIG. 1.

FIG. 2A represents a longitudinal cross section view of the explosion-proof inductive voltage transformer (1000), according to the embodiment of the present invention shown in FIG. 1. FIG. 2A shows the high voltage section (1100) that includes one primary electrical element (1110) that further includes the primary terminal (1111) that receives the high voltage, the current limiting element (1112) that limits the high voltage and reduces its electrical stress, and the insulated element or bushing (1113) that insulates the high voltage. FIG. 2A shows as well that the current limiting element (1112) includes a porcelaincartridge (1114), which in turn includes are extinction sand that immerses a fuse (1115) to provide overcurrent protection, the fuse is mounted on a biberglass core (1116) to provide insulation. FIG. 2A also shows the voltage transforming section (1200) that includes the insulation body (1210), which insulates the voltage transforming section, and the means for reducing the voltage (1220) that includes the primary electromagnetic coil or primary winding (1221), that receives the current from the electricity element (1110) and generates a magnetic field through the magnetic circuit or core (1222), that induces the low voltage to the secondary electromagnetic coil or secondary winding (1223) connected to the electric transmission means, that receives the resulting low voltage; the outside layer (1212) and inside layer (1213 of the insulation body (1210), and the base (1211) to mount the IVT. Additionally, FIG. 2A shows the secondary terminal box (1230) that contains and protects the secondary terminal (1231).

Figure 2B:
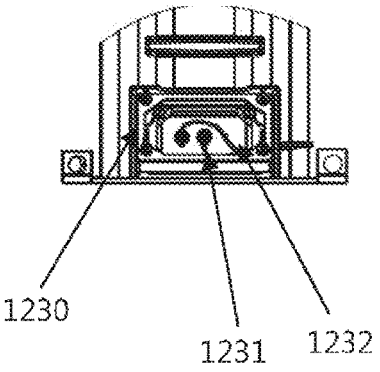
FIG. 2B represents a longitudinal cross section view of the secondary terminal box (1230) containing the secondary terminal (1231) and low voltage distribution line (1232).

FIG. 2B shows in detail the secondary terminal box (1230) that contains and protects the secondary terminal (1231), the secondary terminal (1231) being connected to a low voltage distribution line (1232).

Figure 3:
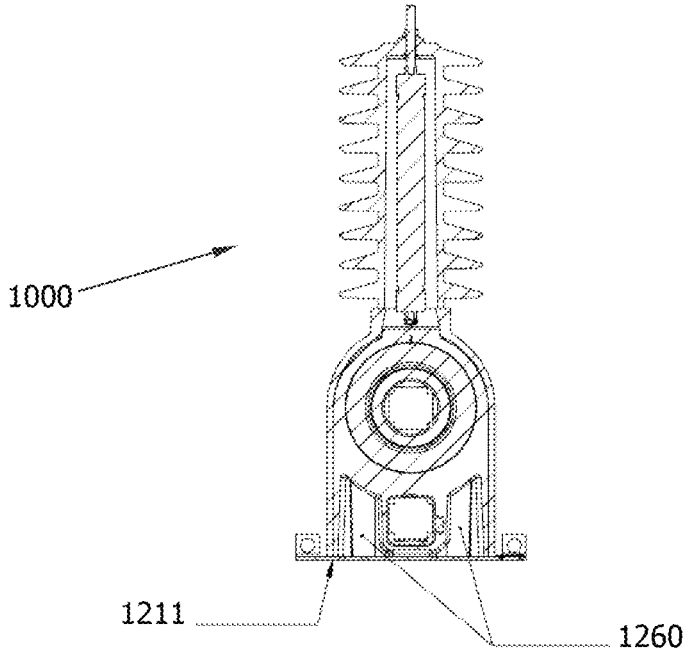
FIG. 3 represents a transverse cross section view of the explosion-proof IVT (1000) shown in FIG. 1.

FIG. 3 represents a transverse cross section view of the explosion-proof IVT (1000), according to the embodiment of the present invention shown in FIG. 1. FIG. 3 represents the transverse cross section view cut through the A-A cross section line (3000) shown in FIG. 1, and it shows a base plate (1211) to mount the IV transformer (1000) and the shock mitigation means (1260) comprise two hollow sections, that during an electrical failure that causes an explosion, said shock mitigation means will direct the gases and shockwave of the explosion towards the two hollow sections, thereby reducing the damage caused by the explosion to the IVT and its surroundings.

Figure 4:
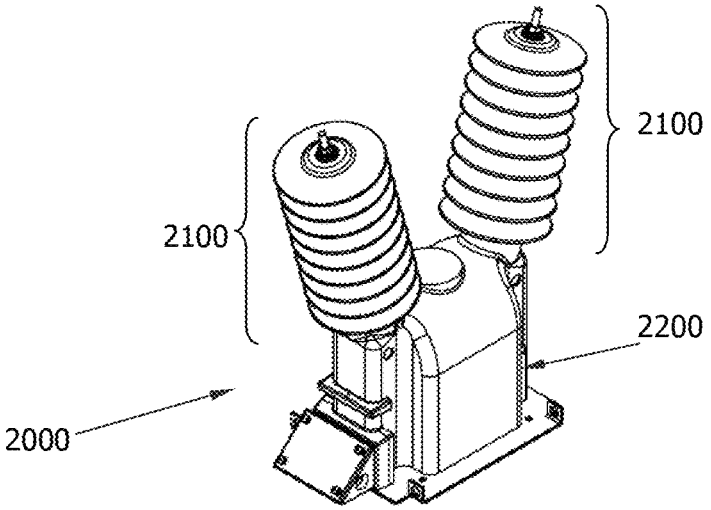
FIG. 4 represents a superior perspective view of an explosion-proof IVT (2000), and a high voltage section (2100), according to another embodiment of the present invention.

FIG. 4 represents a superior perspective view of an explosion-proof inductive voltage transformer (2000), with two primary electrical elements (2100), according to an embodiment of the present invention. FIG. 4 shows the explosion-proof inductive voltage transformer or IVT (2000) of the type including the high voltage section (2100) that receives a high voltage, limits and insulates the high voltage current to be transformed and reduces its electrical stress; and the voltage transforming section (2200) connected to the high voltage section and contained in an insulation body in order to protect the elements of the voltage transforming section and reduce the impact of explosions in case of electrical failure.

Figure 5:
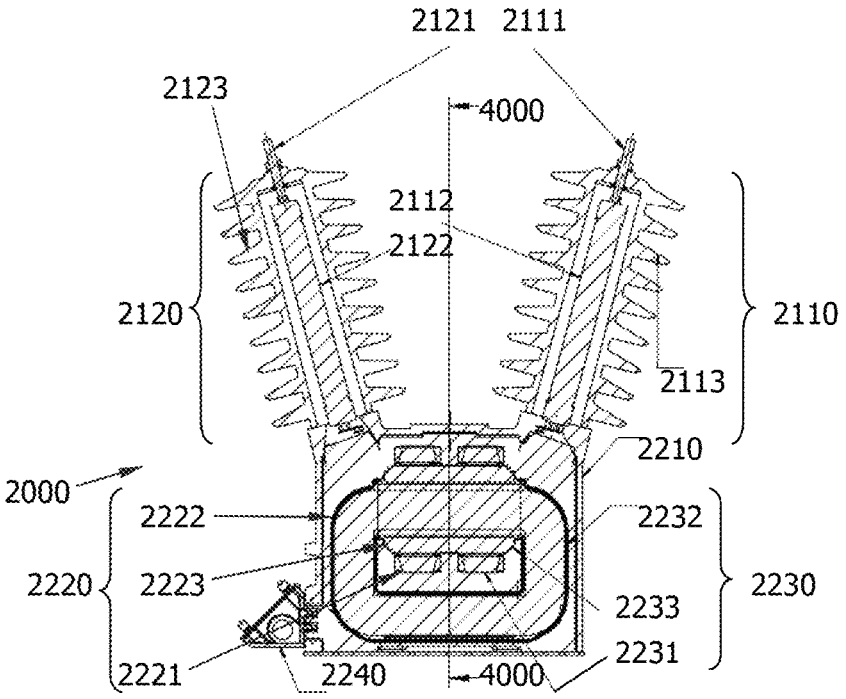
FIG. 5 represents a longitudinal cross section view of the explosion-proof IVT (2000) shown in FIG. 4.

FIG. 5 represents a longitudinal cross section view of the explosion-proof inductive voltage transformer (2000), according to the embodiment of the present invention shown in FIG. 4. FIG. 5 shows the high voltage section (2100) that includes two primary electrical elements (2110 and 2120), wherein each one respectively includes the primary terminals (2111 and 2121) that receive the high voltage, the current limiting elements (2112 and 2122) that limit the high voltage and reduce its electrical stress, and the insulated element or bushing (2113 and 2123) that insulates the high voltage. FIG. 5 also shows the voltage transforming section (2200), that includes the insulation body (2210) that insulates the voltage transforming section; the means for reducing the voltage (2220 and 2230) of the high voltage to a low voltage for each primary electrical element included in the high voltage section that in turn includes two primary electromagnetic coils or primary windings (2221 and 2231), that receive the current from the respective electricity elements (2110 and 2120) and generates a magnetic field through the magnetic circuits or cores (2222 and 2232), that induce the low voltage to the secondary electromagnetic coils or secondary windings (2223 and 2233) connected to the electric transmission means, that receives the resulting low voltage. Additionally, FIG. 5 shows the secondary terminals box (2240) that contains and protects the two secondary terminals (not shown) and the A-A cross section line (4000).

Figure 6:
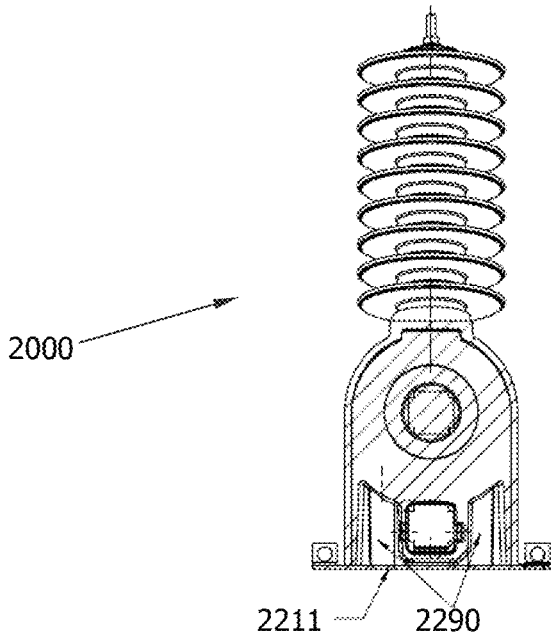
FIG. 6 represents a transverse cross section view of the explosion-proof IVT (2000) shown in FIG. 4.

FIG. 6 represents a transverse cross section view of the explosion-proof inductive voltage transformer (2000), according to the embodiment of the present invention shown in FIG. 4. FIG. 6 represents the transverse cross section view cut through the A-A cross section line (4000), and it shows a base plate (2211) to mount the IVT (2000) and the shock mitigation means (2290) comprise two hollow sections, that during an electrical failure that causes an explosion, said shock mitigation means will direct the gases and shockwave of the explosion towards the two hollow sections, thereby reducing the damage caused by the explosion to the IVT and its surroundings.

The present invention will be better understood from the following examples, which are shown for illustrative purposes only to allow proper understanding of the preferred embodiments of the present invention, without implying that there are no other embodiments non-illustrated which may be practiced based on the above disclosed detailed description.

Example 1

This example shows an electrical failure analysis through finite elements calculation made by the software "COMSOL Multiphysics® 5.0" in order to determine the probability of a failure during a sustained short-circuit in an IVT.

The IVT used in the analysis are shown in the following table. The IV transformer SMM-B-CW, IVT SMM-LME-CW and IVT SMM-LME-SHCEP are different embodiments according to the present invention.

TABLE 1

| Name | Shock mitigation means | Type of insulation (internal) | Type of insulation (external) |
|---|---|---|---|
| IVT B-H | No | B | CW |
| IVT LME-H | No | LME | CW |
| IVT LME-SHCEP | No | LME | S-HCEP |
| IVT SMM-B-H | Yes | B | CW |
| IVT SMM-LME-H | Yes | LME | CW |
| IVT SMM-LME-SHCEP | Yes | LME | S-HCEP |

TABLE 2

| Type of insulation | Features |
|---|---|
| B | Unmodified, solvent-free, bisphenol A based epoxy resin |
| LME | Modified, solvent-free, low viscous epoxy resin based on bisphenol A |
| CW | Cycloaliphatic, hot-curing, epoxy resin |
| S-HCEP | Hydrophobic, cycloaliphatic epoxi resin |

Figure 7:
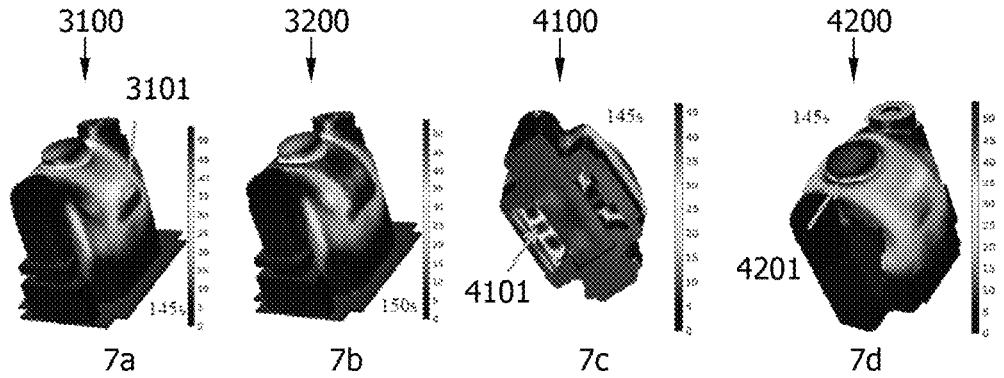
FIG. 7 represents different perspectives views showing the von Mises stress when an electrical failure occurs of a IV transformer without shock mitigation means (3100 and 3200) and an explosion-proof IVT (4100 and 4200) according to an embodiment of the present invention (units in MPa).

Now, FIG. 7 shows the von Mises stress when a failure caused by the sustained short-circuit occurs, FIG. 7*a* shows the IVT B-CW (3100) at the second 145 when the failure caused by the short-circuit is expected to occur (3101), FIG. 7*b* illustrates the IV transformer B-CW (3200) at the second 150, in which the stress is over the resistance of the IVT in a large area and an explosion may occur, FIG. 7*c* illustrates a bottom view perspective of the IVT SMM-B-CW (4100) according to the principles of the present invention at second 145 when the failure caused by the short-circuit is expected to occur (4101), and FIG. 7*d* illustrates a perspective view of the IVT SMM-B-CW (4200) at second 145 when the failure caused by the short-circuit is expected to occur (4201), showing a decrease in the von Mises stress compared to FIG. 7*a* because the gases and the shockwave caused by the explosion are going to be liberated through the shock mitigation means.

Figure 8:
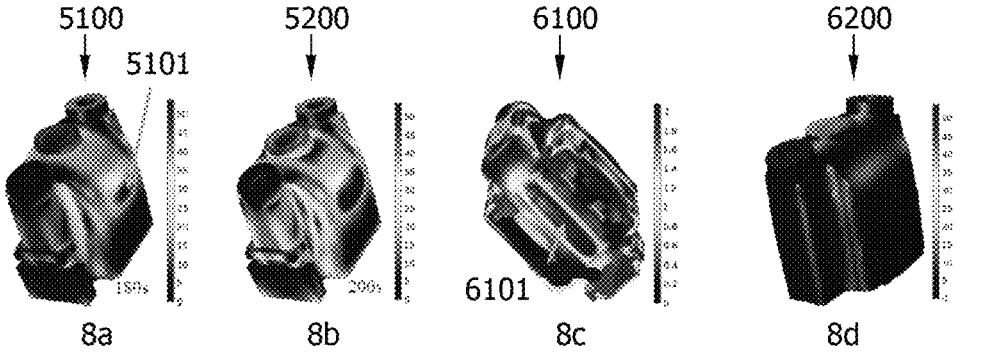
FIG. 8 represents different perspectives views showing the von Mises stress when an electrical failure occurs of a IVT without shock mitigation means (5100 and 5200) and an explosion-proof IVT (6100 and 6200) according to an embodiment of the present invention (units in MPa).

FIG. 8 shows the von Mises stress when a failure caused by the sustained short-circuit occurs, FIG. 8*a* shows the IVT LME-CW (5100) at the second 180 when the failure caused by the short-circuit is expected to occur (5101), FIG. 8*b* illustrates the IVT LME-CW (5200) at the second 200, in which the stress is over the resistance of the IVT and an explosion may occur, FIG. 8*c* illustrates a perspective bottom view of the IVT SMM-LME-CW (6100) according to the principles of the present invention at second 0 when the failure caused by the short circuit is expected to occur (6101), and FIG. 8*d* illustrates a perspective view of the IVT SMM-LME-CW (6200) at second 0, showing a decrease in the von Mises stress compared to FIG. 8*a* and an explosion is not expected to occur.

Figure 9:
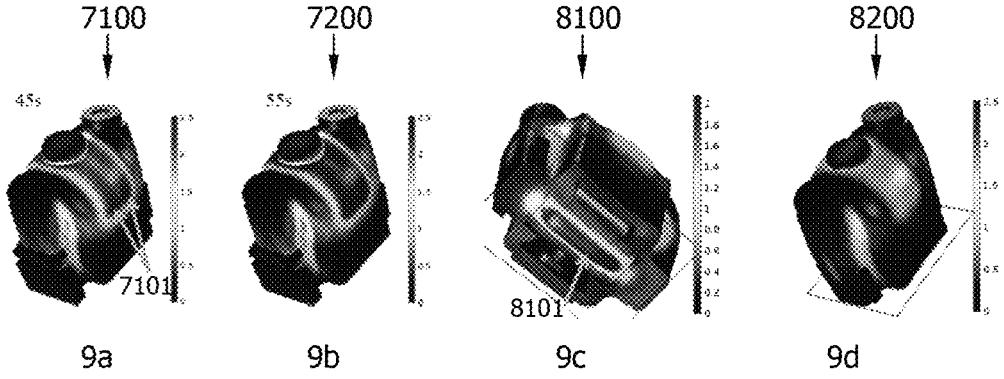
FIG. 9 represents different perspectives views showing the von Mises stress when an electrical failure occurs of a IVT without shock mitigation means (7100 and 7200) and an explosion-proof IVT (8100 and 8200) according to an embodiment of the present invention (units in MPa).

Now, FIG. 9 shows the von Mises stress when a failure caused by the sustained short-circuit occurs, FIG. 9*a* shows the IVT LME-SHCEP (7100) at the second 45 when the failure caused by the short-circuit is expected to occur (7101), FIG. 9*b* illustrates the IVT LME-SHCEP (7200) at the second 55, when the stress is high, FIG. 9*c* illustrates a perspective bottom view of the IVT SMM-LME-SHCEP (8100) according to the principles of the present invention at second 0 when the failure caused by the short circuit is expected to occur (8101), and FIG. 9*d* illustrates a perspective view of the IVT SMM-LME-SHCEP (8200) at second 0, showing a decrease in the von Mises stress compared to FIG. 9*a* and an explosion is not expected to occur, thus the thickness of the insulation body can be reduced.

A summary of the results of the analysis is shown in the following table.

TABLE 2

| Name | Results |
|---|---|
| IVT B-H<br>IVT LME-H | The internal pressure at the time of the short-circuit is high and an explosion may occur |
| IVT LME-SHCEP | The internal pressure at the time of the short-circuit is low, only 10% greater than the initial pressure and no explosion is expected. |
| IVT SMM-B-H | Due to the high pressure inside the transformer an explosion is expected. However, the gases and shockwave caused by the explosion would escape through the shock mitigation means and the damage to the IV transformer would decrease. |
| IVT SMM-LME-H | An explosion is not expected. The location of the fault is at the bottom of the voltage transforming section. |
| IVT SMM-LME-SHCEP | An explosion is not expected. The location of the fault is at the bottom of the voltage transforming section. Due to the decrease of the von Mises stress compared to the IV transformer LME-SHCEP, the thickness of the insulation body can be reduced. |

Example 2

This example shows the mitigation of the damage caused by a short-circuit to the explosion-proof IVT of the present invention with shock mitigation means but no current limiting element.

Figure 10:
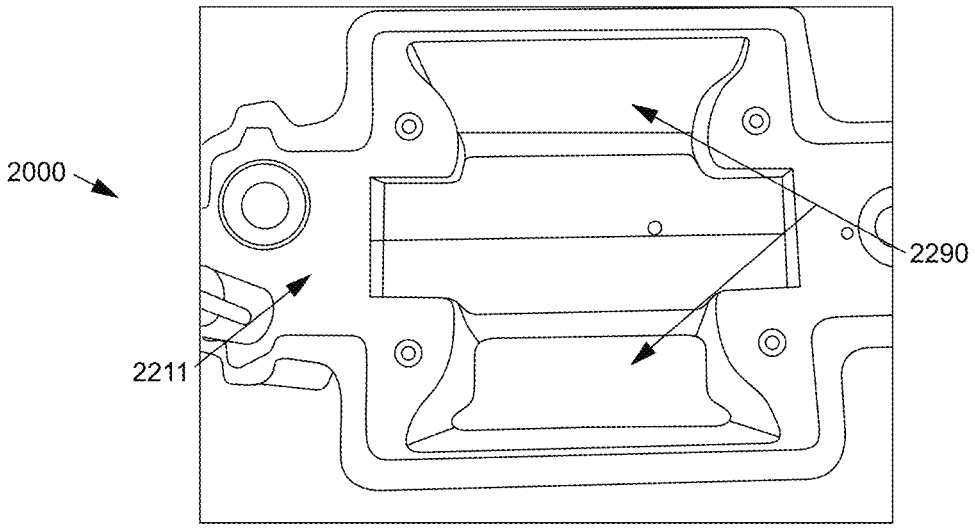
FIG. 10 is a photograph showing a bottom view of an explosion-proof IVT according to the embodiment of the present invention shown in FIG. 4.
Figure 11:
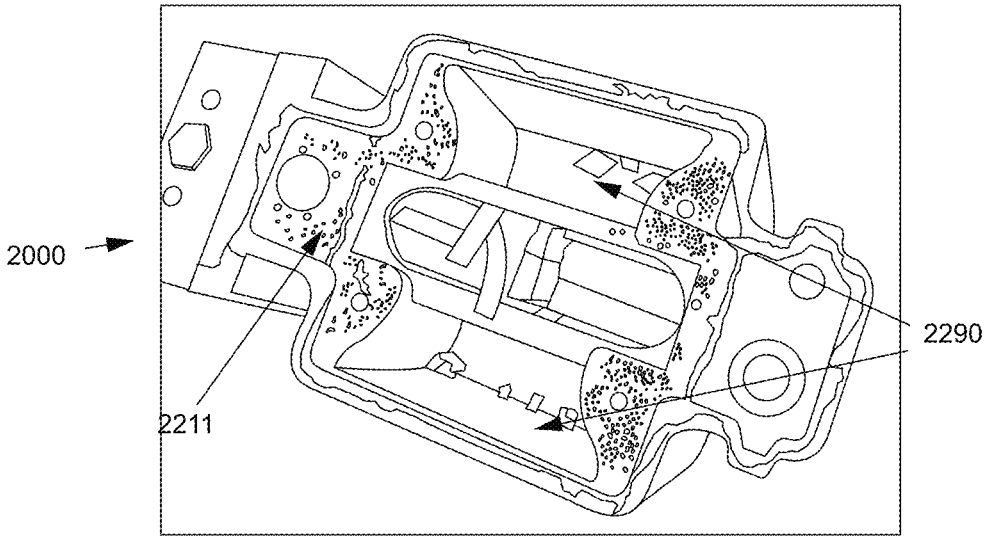
FIG. 11 is a photograph showing a bottom view of an explosion-proof IVT after an electrical failure according to the embodiment of the present invention shown in FIG. 4.

The high voltage section of the transformer is supplied with a voltage equal to the nominal value of 22,000/V3 V and the secondary terminals are short-circuited. The voltage and current is kept constant for about 120 seconds, at this point the primary current increases abruptly due to an internal fault in the IVT, the gases of the explosion caused by the failure are released through the shock mitigation means. After the explosion the transformer has a crack in the lower part but there is no visible fracture in the external body. FIG. 10 shows the bottom view of the IVT (2000), the base (2211) and the shock mitigation means (2290) before the explosion and FIG. 11 shows the bottom view of the IVT (2000), the base (2211) and the shock mitigation means (2290) after the explosion.

Example 3

This example further shows the mitigation of the damage caused by a short-circuit to the explosion-proof IVT of the present invention with both shock mitigation means and current limiting element.

Figure 12:
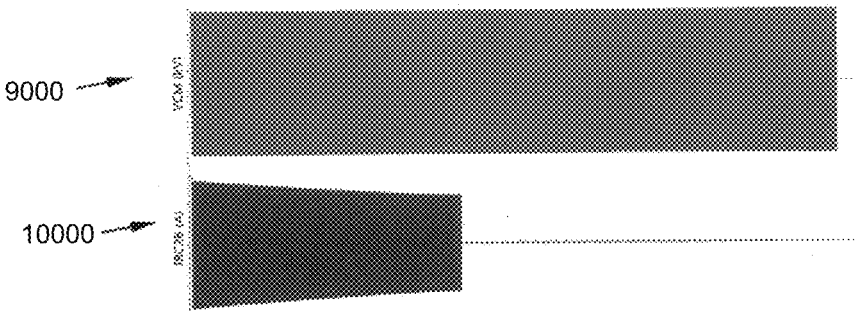
FIG. 12 is a graph that shows the voltage applied (9000) to the explosion-proof IVT (2000) shown in FIG. 4 during a short-circuit and the electric current (10000) that flows through the IV transformer.

The high voltage section of the transformer is supplied with a voltage equal to the nominal value of 22,000/V3 V and the secondary terminals are short-circuited. The tension is kept constant for 180 seconds (9000) and the IVT interrupts the current at second 75 (10000), no damages were caused to the IVT. The above mentioned is shown in FIG. 12.

It is to be understood that the description of the foregoing exemplary embodiments are intended to be only illustrative, rather than exhaustive, of the present invention. Those of ordinary skill will be able to make certain additions, deletions, and/or modifications to the embodiments of the disclosed subject matter without departing from the spirit of the invention or its scope, as defined by the appended claims.

The invention claimed is:

1. An inductive voltage transformer (IVT) comprising:

i) a high voltage section that receives a high voltage, limits and insulates the high voltage to be transformed and reduces electrical stress of the high voltage; and, ii) a voltage transforming section connected to the high voltage section and contained in an insulation body in order to protect the voltage transforming section and reduce an impact of explosions upon electrical failure, wherein the voltage transforming section comprises means for reducing the voltage of the high voltage to a low voltage and electric transmission means to transmit a resulting low voltage to a low voltage distribution line; wherein the voltage transforming section of the inductive voltage transformer further comprises a hollow section located opposite the high voltage section that, during an electrical failure causing an explosion, directs the gases and shockwave of the explosion towards the hollow section, thereby reducing the damage caused by the explosion to the inductive voltage transformer and surroundings of the inductive voltage transformer.

2. The inductive voltage transformer according to claim 1, wherein the inductive voltage transformer is a dry-type inductive voltage transformer.

3. The inductive voltage transformer according to claim 1, wherein the high voltage section is covered by a flexible hydrophobic cycloaliphatic resin.

4. The inductive voltage transformer according to claim 1, wherein the high voltage section comprises a primary electrical element.

5. The inductive voltage transformer according to claim 4, wherein the high voltage section is connected to the voltage transforming section through the primary electrical element of the high voltage section and the means for reducing the voltage of the voltage transforming section, wherein the primary electrical element is separately connected to the means for reducing the voltage of the high voltage current to a low voltage.

6. The inductive voltage transformer according to claim 4, wherein the primary electrical element is covered by cycloaliphatic resin.

7. The inductive voltage transformer according to claim 4, wherein the primary electrical element comprises a primary terminal that receives the high voltage current, a current limiting element that limits the high voltage and reduces the electrical stress, and an insulated element or bushing that insulates the high voltage.

8. The inductive voltage transformer according to claim 7, wherein the current limiting element also absorbs energy caused by the electrical failure and provides insulation.

9. The inductive voltage transformer according to claim 8, wherein the current limiting element further comprises a porcelain cartridge with quartz sand that immerses a silver fuse, which is mounted on a fiberglass core to provide insulation, and overcurrent and heat protection.

10. The inductive voltage transformer according to claim 7, wherein the insulated element or bushing of the primary electrical element is selected from the group consisting of porcelain and resin type insulation.

11. The inductive voltage transformer according to claim 4, wherein the voltage transforming section comprises means for reducing the voltage for the primary electrical element included in the high voltage section.

12. The inductive voltage transformer according to claim 11, wherein the means for reducing the voltage of the high voltage to a low voltage comprises:

a primary electromagnetic coil or primary winding;

a magnetic circuit or core; and a secondary electromagnetic coil or secondary winding; and wherein the primary electromagnetic coil or primary winding receives the high voltage from the primary electrical element and generates a magnetic field through the magnetic circuit or core; and the magnetic circuit or core induces the low voltage to the secondary electromagnetic coil or secondary winding; wherein the secondary electromagnetic coil or secondary winding is connected to the electric transmission means that receives the resulting low voltage.

13. The inductive voltage transformer according to claim 12, wherein the means for reducing the voltage of the high voltage to a low voltage comprises a second primary electromagnetic coil or primary winding.

14. The inductive voltage transformer according to claim 1, wherein the insulation body of the voltage transforming section comprises an outside layer and an inside layer made of polymeric materials to insulate the voltage transforming section, and a base to mount the inductive voltage transformer.

15. The inductive voltage transformer according to claim 1, wherein the electric transmission means comprise a secondary terminal that receives the resulting low voltage and may be connected to a low voltage distribution line; and a secondary terminal box that contains and protects the secondary terminal.

16. The inductive voltage transformer according to claim 1, further comprising a second hollow section.

17. The inductive voltage transformer according to claim 16, wherein the hollow section and the second hollow section are located opposite the high voltage section at the bottom-lateral ends of the inside layer of the insulation body.

18. The inductive voltage transformer according to claim 1, wherein the electrical failure is selected from the group consisting of a short circuit, ferroresonance occurrence, a power surge, an internal electric arc and an internal arc discharge.

* * * * *